United States Patent [19]

Kirman

[11] 4,043,807

[45] Aug. 23, 1977

[54] ALLOY STEELS

[75] Inventor: Ivor Kirman, Birmingham, England

[73] Assignee: The International Nickel Company, Inc., New York, N.Y.

[21] Appl. No.: 656,984

[22] Filed: Feb. 10, 1976

Related U.S. Application Data

[63] Continuation-in-part of Ser. No. 420,112, Jan. 2, 1974, abandoned.

[51] Int. Cl.[2] ..... C22C 38/04; C22C 38/12; C22C 38/16

[52] U.S. Cl. ..... 75/125; 75/123 B; 75/123 E; 75/123 H; 75/123 J; 75/123 K; 75/123 N; 75/124; 148/36

[58] Field of Search ..... 75/124, 125, 123 B, 75/123 E, 123 H, 123 N, 123 J, 123 K; 148/36

[56] References Cited

U.S. PATENT DOCUMENTS

| | | | |
|---|---|---|---|
| 3,592,633 | 7/1971 | Osuka et al. | 75/124 |
| 3,666,570 | 5/1972 | Korchynsky et al. | 148/36 |
| 3,783,040 | 1/1974 | Ballance et al. | 148/36 |
| 3,897,279 | 7/1975 | Shaughnessy et al. | 148/36 |
| 3,899,368 | 8/1975 | Waid et al. | 148/36 |

FOREIGN PATENT DOCUMENTS

| | | | |
|---|---|---|---|
| 54,709 | 3/1967 | Germany | |
| 1,170,569 | 11/1969 | United Kingdom | 148/36 |

*Primary Examiner*—Arthur J. Steiner
*Attorney, Agent, or Firm*—Raymond J. Kenny; Ewan C. MacQueen

[57] ABSTRACT

An alloy steel containing correlated percentages of nickel, copper, carbon, niobium, manganese, aluminum, chromium, molybdenum, silicon, boron, etc., the alloy being characterized by a combination of high strength and good toughness.

7 Claims, No Drawings

ALLOY STEELS

The subject invention is addressed to ferrous metallurgy, and particularly to steels which offer such a combination of high strength, toughness and weldability that they are particularly useful for shipbuilding purposes, and is a continuation-in-part of Ser. No. 420,112, field Jan. 2, 1974, now abandoned.

As is well known, there are a number of applications which demand steels which manifest a reasonable degree of tensile strength, resistance to impact and weldability. This is particularly evident in respect of the shipbuilding industry, such steels also being required to exhibit cold formability. And in order to be assured of commercial acceptance in some areas any such new steel composition must meet the specifications of certain classification societies, one requirement being that the steel additionally possess a carbon equivalent which, for steels not containing vanadium, is determined by the formula:

$$C + \frac{Mn}{6} + \frac{Cr + Mo}{5} + \frac{Ni + Cu}{15}$$

of not more than 0.41. (Each symbol represents the weight percentage, if any, of the particular element present in the steel.)

For some steel products such as angular sections it is often necessary, unavoidable or economically desirable to employ hot rolling techniques that may involve finishing some parts at temperatures on the order of 1000° C. to minimize damage and wear of the rolls. But by reason of this, full and consistent benefit of low-finish rolling temperatures on strength and toughness cannot be achieved. There is, therefore, a demand for steels which also possess improved properties in the as-rolled condition after employing such high finishing temperatures and an object of the instant invention is to satisfy this demand.

We have now found that the aforediscussed combination of metallurgical properties can generally be obtained in the as-rolled condition provided the steels contain (weight percent) from about 0.4 to 0.8% nickel, from 0.7 to 1.1% copper, from 0.01 to 0.09% carbon, from 0.02 to 0.1% niobium, from 1.2 to 1.65% manganese, from 0 to 0.5% chromium, from 0 to 0.6% silicon, from 0 to 0.5% molybdenum, from 0 to 0.01% boron, from 0 to 0.08% aluminum and from 0 to 0.1% in total of one or more of the elements zirconium, magnesium, calcium and rare earth metals, the balance, except for impurities and incidental elements, being essentially iron.

In general, these steels, in section thicknesses of about 15 to 35 mm, possess a strength level of the order of at least 450 $MN/m^2$ and a toughness level such that the 70J longitudinal impact transition temperature is below −10° C. when prepared at finishing temperature up to 1050° C.

In carrying the invention into practice and in order to consistently achieve the desired combination of characteristics, it is essential that the constituents of the steels be correlated in accordance with the above ranges. In this connection, nickel strengthens and toughens the steels and at least 0.4% should be present for this purpose. Additionally, the nickel content is preferably at least half the copper content in order to ensure freedom from hot shortness under normal processing conditions. However, little additional benefit is obtained at nickel contents exceeding 0.8%, given the increased cost. Preferably, the nickel is from 0.5 to 0.7%.

Copper acts as a solid solution strengthener and can cause age-hardening by auto-aging during cooling after hot-rolling and during welding. At least 0.7% copper is necessary for these reasons. With increasing copper content, more nickel must be present to counteract hot-shortness and the copper content should therefore not exceed 1.1%. Preferably the percentage of copper is maintained at from 0.8 to 1.0%.

Carbon and niobium act as strengtheners and grain refiners. For adequate strength and grain refinement the niobium content should be at least 0.02% but levels above 0.1% lead to reduced toughness. Beneficially niobium is from 0.05 to 0.09%. Carbon in excess of 0.09% has a detrimental effect on toughness, weldability and cold formability and advantageously it does not exceed 0.06%.

Manganese strengthens the steels and at least 1.1% (or 1.20%) is necessary for this purpose. Below this figure both strength and thoughness are detrimentally effected. Given at least certain of the prior art, the role of manganese in terms of toughness is indeed surprising. In any case, manganese above 1.65% leads to poor weldability and cold formability. It is preferred that this constituent be from 1.2 to 1.4%.

Chromium, silicon, molybdenum and boron all act as supplementary strengthening agents and up to 0.5% chromium, up to 0.6% silicon, up to 0.5% molybdenum and up to 0.01% boron may be present for this purpose.

Chromium and molybdenum in excess of 0.5% unnecessarily adds to the cost of the alloys, and moreover, these elements have a large effect on the carbon equivalent value. Silicon in excess of 0.6% detrimentally affects weldability, and it is to advantage that the silicon content is from 0.2 to 0.4%. Amounts of boron in excess of 0.01% decrease toughness and preferably the boron percentage is from 0.002 to 0.004%.

Aluminum may be present in amounts up to 0.08% for the purpose of killing steels but amounts in excess of this figure detrimentally affect ductility. A range of 0.005 or 0.01% to about 0.05% is quite satisfactory.

One or more of the elements zirconium, magnesium, calcium and rare earth metals in a total amount up to 0.1% renders the steels more isotropic with regard to toughness, i.e., reduces the difference between the longitudinal toughness (i.e., normal to the rolling direction). Of these elements, magnesium is particularly effective. In addition, zirconium in particular renders the steels more isotropic with regard to impact transition temperature. A total content of from 0.02 to 0.06% of these elements is preferred. Rare earth metals can be conveniently added in the form of Mischmetall of cerium silicides; zirconium, magnesium and calcium may be added in the form of nickel-rich master alloys.

Residual elements and impurities such as phophorus, sulfur and tin should be kept as low as possible consistent with good steel-making practice. The presence of titanium in an amount exceeding 0.04% as an alternative to aluminum is undesirable because titanium interferes with the formation of carbides of other elements in the steels, whose formation is essential for obtaining the desired properties.

An especially preferred steel composition of the invention contains essentially 0.55% nickel, 0.9% copper, 0.04% carbon, 0.08% niobium, 1.3% manganese, 0.3% silicon and 0.04% aluminum, the balance, except for impurities, being iron.

Some examples will now be given.

Steels having the composition shown in the Table I were air melted and cast as 25 kg ingots, each being 100m × 100m × 250mm. Each ingot was soaked for two hours at 1200° C. and held for 50 seconds before rolling. The finishing temperature and thickness of the resulting plate are shown in Table I. After rolling, the plates were air cooled. Tensile and impact test were performed on specimens from each of the rolled plates and the results are also reported in Table I.

TABLE I

| Alloy No. | COMPOSITION* (%) Ni | Cu | C | Nb | Mn | Si | Al | Other |
|---|---|---|---|---|---|---|---|---|
| 1 | 0.57 | 0.92 | 0.052 | 0.10 | 1.33 | 0.20 | 0.045 | — |
| 2 | 0.74 | 0.96 | 0.059 | 0.07 | 1.23 | 0.18 | 0.055 | 0.02 Ca |
| 3 | 0.55 | 0.98 | 0.049 | 0.06 | 1.21 | 0.31 | 0.03 | — |
| 4 | 0.55 | 0.98 | 0.049 | 0.06 | 1.21 | 0.31 | 0.03 | — |
| 5 | 0.55 | 0.98 | 0.049 | 0.06 | 1.21 | 0.31 | 0.03 | — |
| 6 | 0.54 | 1.06 | 0.051 | 0.09 | 1.10 | 0.27 | 0.05 | 0.002 B |

| Alloy No. | Finishing Temp. (° C.) | Plate Thickness | Y.S. (MN/m²) | U.T.S. (MN/m²) | El. % | 70J Transition Temperature (° C.) Long. | Trans. |
|---|---|---|---|---|---|---|---|
| 1 | 980 | 20 | 486 | 648 | 20.5 | −43 | −16 |
| 2 | 980 | 20 | 480 | 600 | 21.0 | −55 | −50 |
| 3 | 950 | 20 | 471 | 610 | 23.8 | −40 | −38 |
| 4 | 1000 | 20 | 480 | 615 | 21.5 | −38 | −25 |
| 5 | 950 | 35 | 450 | 563 | 22.0 | −40 | −13 |
| 6 | 1050 | 20 | 479 | 591 | 27.0 | −30 | — |

*Balance iron and impurities

The results given in Table I reflect that each of the exemplified steels possessed the target properties in the as-rolled condition, i.e., a strength level of the order of at least 450 NM/m² and a toughness level such that the 70J longitudinal impact transition temperature is below −10° C. when provided at finishing temperatures up to 1050° C.

The effect of manganese is depicted in Table II, the steels being processed such as in connection with Table I, compositions A, B and C being outside the scope of the invention.

TABLE II

| Alloy | Ni % | Cu % | C % | Nb % | Si % | Al % | B % | Mn % | Fe % | Section Size mm | YS/PSI N/mm² | 70J Transition Temperature ° C. |
|---|---|---|---|---|---|---|---|---|---|---|---|---|
| A | 0.58 | 0.82 | 0.067 | 0.06 | 0.07 | 0.052 | 0.002 | 0.61 | Bal. | 15 | 443 | −5 |
| | | | | | | | | | | 35 | 388 | +50 |
| B* | 0.54 | 0.81 | 0.090 | 0.07 | 0.10 | 0.035 | 0.002 | 0.43 | Bal. | 15 | 455 | +40 |
| | | | | | | | | | | 35 | 434 | +50 |
| 7 | 0.77 | 1.01 | 0.068 | 0.06 | 0.11 | — | 0.003 | 1.13 | Bal. | 15 | 463 | −30 |
| | | | | | | | | | | 35 | 464 | 0 |
| C | 0.52 | 0.93 | 0.047 | 0.030 | 0.16 | 0.020 | <0.002 | 0.64 | Bal. | 20 | 434 | +10 |
| 8 | 0.45 | 0.92 | 0.072 | 0.040 | 0.33 | 0.026 | <0.002 | 1.18 | Bal. | 20 | 480 | +5 |
| 9 | 0.46 | 0.75 | 0.043 | 0.040 | 0.26 | 0.025 | <0.002 | 1.20 | Bal. | 20 | 453 | +10 |

*Alloy B contained 0.34% Cr

A comparison of steels A, B and 7 and also C, 8 and 9 indicates that in terms of strength and toughness Alloys 7, 8 and 9 are quite superior.

In addition to the foregoing, it might be mentioned that rather conventional levels of nitrogen do not detract from the subject steels. This is evident from the steels reported in Table III.

TABLE III

| Alloy | C % | Si % | Mn % | Ni % | Cu % | Nb % | N % | O % | Fe % |
|---|---|---|---|---|---|---|---|---|---|
| 10 | .069 | .44 | 1.38 | .50 | .97 | .038 | .008 | .017 | Bal. |
| 11 | .078 | .42 | 1.35 | .50 | .97 | .036 | .009 | .015 | Bal. |

Note: Alloy A contained less than 0.01% Al, whereas 84 Alloy B contained 0.051% Al The percent elongation for the above alloys was above 24% in each instance in the longitudinal as-rolled condition, the ultimate tensile strength being approximately 615 MN/m², with reduction in area being well above 65%. Impact transition temperatures were very good. (Alloy 7 contained 0.008% nitrogen.)

Although it is an advantage that the steels of the invention possess the desired combination of properties in the as-rolled condition including having been finished rolled at 900° to 1075° C., it is of course possible to improve their properties by performing subsequent heat-treatments. Thus, for example, the steels may be quenched directly after hot-rolling to improve strength without loss of toughness. Strength levels (Y.S.) following such a heat treatment would commonly be of the order of 600 to 700 MN/m².

A standard aging treatment comprising, for example, heating the steels for one to four hours at 500° to 600° C., followed by air cooling will in general increase strength levels by the order of 30 to 40 MN/m² but cause a corresponding loss in toughness. Conversely a normalizing treatment, for example, for one hour at 900° C., will in general increase toughness but cause a corresponding loss in strength. However, a normalizing treatment followed by againg will in general benefit both strength and toughness.

The steels of the invention have been described as being particularly useful for shipbuilding purposes, but it should be appreciated that the steels may be used to advantage in any application requiring one or more of the combination of properties exhibited by them.

I claim:

1. A low alloy, high strength steel characterized by good toughness, weldability and cold formability and consisting of from about 0.01 to 0.09% carbon, about 0.4% to about 0.8% nickel, about 0.7% to about 1.1% copper, about 0.2 to about 0.1% niobium, about 1.1% to about 1.65% manganese, aluminum present up to 0.08%, up to 0.5% each of chromium and molybdenum, up to about 0.6% silicon, up to about 0.01% boron, up to about 0.1% of at least one metal selected from the group consisting of zirconium, magnesium, calcium, and rare earths, the balance being essentially iron, said steel being further characterized in that the carbon equivalent expressed by the formula:

$$C + \frac{Mn}{6} + \frac{Cr + Mo}{5} + \frac{Ni + Cu}{15}$$

is not more than 0.41, said steel being further characterized in that the strength level is at least about 450 $MN/m^2$ and the 70J longitudinal impact transition temperature is below about −10° C. over section thickness of at least 15 to 35 mm notwithstanding that the steel was finished hot rolled at a temperature up to 1050° C.

2. A steel in accordance with claim 1 containing 0.5% to 0.7% nickel, 0.8% to 1% copper, 0.05% to 0.09% niobium, 0.01% to 0.06% carbon, and 1.2% to 1.4% manganese.

3. A steel in accordance with claim 1 containing at least one metal from the group consisting of zirconium, magnesium, calcium and rare earths in a small but effective amount sufficient to render the steel more isotropic.

4. A steel in accordannce with claim 3 containing from 0.02% to 0.06% of at least one metal from the groups consisting of zirconium, magnesium, calcium, and rare earths.

5. A steel in accordance with claim 3 containing magnesium.

6. A steel in accordance with claim 3 containing zirconium.

7. A steel in accordance with claim 1 containing about 0.002% to 0.004% boron.

* * * * *